US005092659A

United States Patent [19]

Grathoff

[11] Patent Number: 5,092,659

[45] Date of Patent: Mar. 3, 1992

[54] CONTINUOUS TRACK-MOUNTED, SELF-PROPELLED OPEN-CAST MINING MACHINE

[76] Inventor: Hartmut Grathoff, Am Wiesengrund 14, 8508 Wendelstein, Fed. Rep. of Germany

[21] Appl. No.: 540,645

[22] Filed: Jun. 19, 1990

[30] Foreign Application Priority Data

Jun. 20, 1989 [DE] Fed. Rep. of Germany ..... 3920011
Jul. 25, 1989 [DE] Fed. Rep. of Germany ..... 3924675

[51] Int. Cl.[5] ..... E02F 3/24; E21C 47/04

[52] U.S. Cl. ..... 299/39; 37/97; 37/190; 299/85

[58] Field of Search ..... 37/94, 95, 97, 189, 37/190, DIG. 1, DIG. 20; 299/67, 85, 88, 89, 18, 39

[56] References Cited

U.S. PATENT DOCUMENTS

| | | | |
|---|---|---|---|
| 3,612,246 | 10/1971 | Elze et al. | 37/190 X |
| 4,009,531 | 3/1977 | Metrier | 37/190 X |
| 4,120,106 | 10/1978 | Smith et al. | 37/190 |

FOREIGN PATENT DOCUMENTS

| | | | |
|---|---|---|---|
| 1749015 | 11/1956 | Fed. Rep. of Germany . | |
| 3134975 | 3/1983 | Fed. Rep. of Germany | 299/39 |
| 1204727 | 1/1986 | U.S.S.R. | 299/85 |
| 1116428 | 6/1968 | United Kingdom | 37/190 |
| 2081345 | 2/1982 | United Kingdom | 37/190 |

OTHER PUBLICATIONS

Gunther Linder, "Das Schaufelrad und seine vielsetige Anwendumg", *Deutsche Hebe-und Fordertechnick* pp. 3-16, 7-1957.

Goergen et at., "Das Frasmachine 3000 SM/3800 SM als neues tragebaugerüt", *Braunkohle* 36, pp. 92-95, 4-1984.

*BTU Magazine* "The Satterwhite Wheel" pp. 14, 19-21, 10-1986.

*Primary Examiner*—David J. Bagnell
*Attorney, Agent, or Firm*—McGlew & Tuttle

[57] ABSTRACT

A continuous track-mounted, self-propelled continuously operating open-cast mining machine having a drum-shaped mining device with cutting tools arranged around the circumference of the drum. The cutting drum is equipped with cutting teeth which can cut in both directions and the mined material is guided into the interior of the cutting drum, with the cutter bars being arranged in a substantially axial pattern on the circumference of the drum. The teeth holders are arranged on the cutter bars and carry teeth and the teeth holders with the teeth are pivotable about an axis in such a way that the teeth pointing in the directin of rotation of the drum pivot automatically into the cutting position as they engage in the material to be extracted, while the teeth pointing in the opposite direction are simultaneously pivoted out of the clearance angle zone of the teeth doing the actual cutting. The mined material is transported by the cutter bars and by flights via a curved liner and a feed chute onto a discharge belt arranged axially inside the cutting drum. The cutter bars are joined together with the rotating ring members by conical rings bearing radially arranged ribs; and the discharge belt carries the mined material to the end of the drum where the material is transferred to further conveyor belts located outside the cutting drum.

19 Claims, 11 Drawing Sheets

CONTINUOUS TRACK-MOUNTED, SELF-PROPELLED OPEN-CAST MINING MACHINE

FIELD OF THE INVENTION

This invention relates to a continuous track-mounted, self-propelled, continuously operating open-cast mining machine, having a drum-shaped breaking device with cutting tools arranged around the periphery of the drum.

BACKGROUND OF THE INVENTION

Surface-cutting machines are used for cutting roadways or for stripping away old road surfaces. Such machines are fitted with cutting drum of small diameter and travel on continuous tracks. The material such machines remove is thrown onto an intermediate conveyor belt fitted with a receiving hopper, which is arranged between the rear continuous track units, seen relative to the direction of travel of the machine. This intermediate conveyor belt then discharges the material onto a discharge belt which is pivotable to permit the loading of trucks. The machine possesses a relatively low cutting height. One disadvantage of this machine is that it can cut in only one direction, i.e. if cutting is to be carried out in the opposite direction, the machine has to be turned around 180°.

In addition, there is a known type of open-cast mining machine which operates according to the "Satterwhite" principle. In this machine four overhead-type bucket wheels arranged side by side at the front of the device dump the extracted material onto two transverse belts arranged behind the bucket wheel, and these belts in turn discharge onto an intermediate belt running opposite to the direction of travel of the machine. This belt connects with a pivotable discharge belt used for loading trucks. This machine can achieve a higher digging force only with the aid of a skid on which the machine rests. The tractive effort of the machine is relatively low and the machine can operate only at a relatively small angle of inclination. There is only limited space to install a powerful drive unit in the cutting device. One major disadvantaqe of the machine is that it can travel in one cutting direction only and therefore must be completely turned around in order to cut in the other direction.

SUMMARY AND OBJECTS OF THE INVENTION

It is an object of the invention to improve a state-of-the art continuous track-mounted self-propelled open-cast mining machine in such a way that mining can be carried out in both directions without having to turn the machine around. At the same time, by cutting a thick slice, the machine should be able to achieve a high rate of performance. Furthermore, the machine should be able to follow inclined seams better than can be done by mining machines of the known design.

It is a further object of the invention to construct the open cast mining machine in such a way that it retains a given load distribution on the tracks of the continuous track system. Also that the spatial attitude of the chassis, once set, is maintained so that the conveying devices on the machine and the connecting bridge attached to it do not tilt, and finally to ease the work of the machine operator.

According to the invention, a cutting drum fitted with cutting teeth can carry out cutting in both directions. The mined material is directed into the interior of the cutting drum. Cutter bars are arranged in a substantially axial configuration around the circumference of the drum and teeth holders mounted on the cutter bars carry teeth. The teeth holders with the teeth are tiltable about an axis in such a manner that the teeth, angled upwards in the direction of rotation, automatically pivot into the cutting position as they engage in the material to be extracted, and the teething point in the opposite direction are simultaneously swung out of the clearance angle zone of the teeth doing the cutting. The material mined is transported by the cutter bars and the flights over a curved liner and a feed chute onto a discharge belt axially arranged within the cutting drum. This belt transports the mined material to the end of the cutting drum and discharges it onto further conveyors located outside the cutting drum.

The mining machine is equipped with two sets of continuous track units which can be raised and lowered independently of each other by means of lift cylinders and parallelogram links. Sensors are provided to divide u the loads via a programmable controller between the individuals continuous track units and to ensure that the attitude of the equipment chassis is maintained during the various operating phases of the mining machine.

With the open-cast mining machine according to the invention, it is possible to achieve high rates of extraction at large cutting depths in both travel directions and without turning the machine around, i.e. without loss of time. Thanks to the high digging forces which it exerts, the machine is suitable for extracting very hard material. The type of cutting tools used permits a relatively high degree of comminution of the mined material, therefore it is usually not necessary to operate the machine in conjunction with a crusher.

The installation of high-power drive machinery in the mining machine is extremely straightforward according to the invention. The digging force of the cutting drum provides additional tractive force, thereby permitting the machine to operate at a large angle of inclination. Thanks to the design of the continuous track system, the machine is able to follow the path of dipping seams better than a bucket-wheel excavator.

Compared with a bucket-wheel excavator, the open-cast mining machine according to the invention is of small and lightweight construction. Naturally, this also favorably affects the procurement cost of the machine.

The cutting drum, which can rotate in both directions, is designed to permit the mined material to pass from the outside to the inside, like a cell-less bucket wheel. The cutting drum is made up of cutter bars arranged axially around the periphery and connected together by several rings. The cutter bars may also, if appropriate, be arranged in a helical pattern running approximately 10° to 20° to the axial direction in order to achieve shock-free cutting by the cutting drum. The cutter bars carry teeth holders which tilt about a rotational axis and which stand at an angle of about 45° to the direction of peripheral rotation during the cutting process. The cutting teeth preferably resemble the cutting tools known from underground mining machinery. If, however, easily minable material (such as sand, loam or similar) is to be extracted, then spade teeth, of the kind known from shovel buckets, may also be used.

The digging teeth of the cutting drum are in contact with the material to be mined while the teeth required for the opposite direction of cutting are pivoted out of the area of the clearance angle. Because of its construction, consisting of cutter bars joined together by rings, the cutting drum possesses in its peripheral direction the form of a reticulate drum with compartments to receive the mined material. As the drum rotates, the cutter bars and the flights, in conjunction with the two halves of the curved liner, transport the mined material to the fixed receiving chute which discharges the material into the interior of the drum onto an axially oriented discharge conveyor belt. The discharge conveyor belt transports the material out of the end of the drum onto a bridging conveyor belt and then via a hopper car onto the bench conveyor belt.

The cutting drum is suspended at both ends in large anti-friction bearings. Drive pinions engage in gear teeth on the anti-friction bearings and cause the cutting drum to rotate. As already mentioned above, the cutting drum can be rotated in either direction.

The cutting drum requires at least one drive unit. However, advantageously two drives with two drive pinions per drive are provided on each side of the cutting drum. Planetary multiple transmission path gearing may be used for this purpose.

The mining machine is moved in a known manner by means of continuous track system consisting of four powered continuous track units. These continuous track units are arranged in pairs of front of and behind the cutting drum and can be raised and lowered independently of each other by means by means of hydraulically operated parallelogram links. The continuous track units can in addition be steered in pairs, i.e. the front and rear pairs of continuous tracks can be steered independently of each other.

By appropriately adjusting the vertical setting of the continuous tracks, the mining machine can be matched to the respective cut height selected for mining purposes. Depending on the travel direction the front continuous tracks can be set high and the rear continuous track low, with the front height adjustment determining the cut height.

Fundamentally, it is also conceivable to fit the mining machine with wheeled undercarriage instead of continuous track units.

The sensors and control system for the open-cast mining machine automatically provide uniform adjustment of the continuous track system and thus achieve optimal distribution of the load over all the continuous track units. The chassis of the mining machine always retains its pre-set attitude.

For reasons of stability and in order to have continuous tracks of identical design at the front and rear of the mining machine, it is advantageous to fit two continuous track units at the front and another two at the rear. However, because of the low travel speeds in the mining machine according to the invention, it is not necessary to spring mount the continuous track units on the machine chassis. Furthermore, this would not be conducive to promoting problem-free operation of the machine.

When the continuous track units are rigidly attached to the machine chassis the support is correspondingly statically indeterminate, so that, for example, when one of the two adjacent continuous track units in a track system lifts off, the load on the raised continuous track is reduced and the load on the adjacent continuous track is increased by the same amount.

For this reason, the invention provides each of the four continuous track units in a continuous track system with a force sensor which measures the vertical support force relative to the machine chassis. Vertical travel sensors measure the vertical position of the respective continuous track unit.

In addition, in the machine according to the invention, an attitude sensor is attached to the chassis to measure the angular inclination of the chassis relative to the geocenter, both in the direction of travel of the mining machine and also transverse thereto.

The measurements from all the aforementioned sensors are fed constantly to a programmable controller located in the operator's cab on the mining machine. The programmable controller is also fed with the set values for the angular positions of the machine chassis and also with the desired amount by which, for example, the front continuous tracks of the track system should be set higher than the rear continuous tracks, i.e. this dimension is also the same as the thickness of the mined slice (h).

In addition, the programmable controller is fed with the intended ratio according to which the load is to be split between the respective adjacent continuous track units in the track system.

Depending on the data received from the four force sensors, the torque exerted by the continuous track drives is split up by the programmable controller.

At the beginning and end of each mining run the cutting device of the machine must cut a ramp. For this purpose, the given ramp length (l) and the slice (h), or the angle of ramp inclination ($\alpha$) are fed to the programmable controller. After these data have been evaluated, the position of the continuous track units is adjusted by the lifting cylinders of the parallelogram links so that the desired ramp geometry is attained and the machine chassis retains the desired transverse and longitudinal inclination.

While the mining machine is being transported, all four continuous track units are positioned at their lowest setting.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
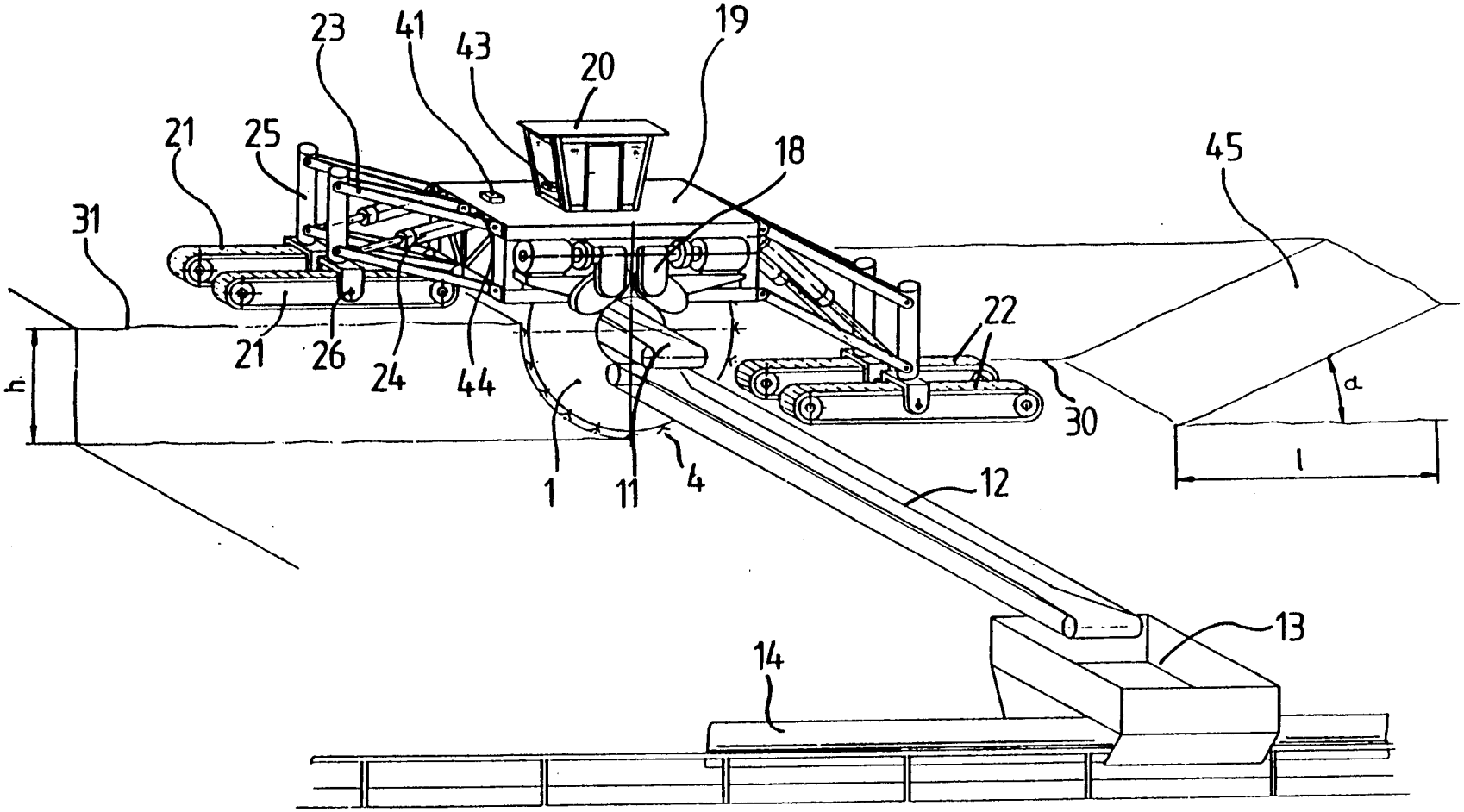
FIG. 1 is a perspective view of a mining machine according to the invention.

Referring to the drawings, in particular, FIG. 1 shows the mining machine according to the invention while operating in an open-cast mine. The cutting drum 1 is shown in contact with the slice to be mined. The cutting teeth 4 are engaged in the mining face. While the cutting drum 1 and the rear continuous tracks 22 run along the lower bench 30, the front continuous track units 21 run on the upper bench. The height or depth adjustment of the continuous track system is achieved by means of parallelogram links 23, which are adjusted by means of lifting cylinders 24.

The drive 18 of the cutting drum 1 can be seen on the end face of the drum in FIG. 1.

Also on the end face of the drum, the discharge conveyor belt 11 emerges from the interior of the drum and dumps the mined material onto the bridge conveyor 12. The bridge conveyor 12 is attached to the mining machine by means of a cardanic linkage (not shown in the figure). The other end of the bridge conveyor 12 is likewise cardanically attached to the hopper car 13.

According to the present state of the art, bridge conveyors are attached at two points at one end and at one point (possibly imaginary) at the other end, so that a statically determinate three-point suspension is formed. In the mining machine according to the invention the end of the bridge conveyor 12 beneath the drum discharge belt 11 is advantageously attached at two points and the opposite end is attached at a single point.

The mined material is delivered by the bridge conveyor 12 to the hopper 13, and from there it is taken away by the bench belt conveyor 14 running beneath the hopper car.

The hopper car 13 usually runs on the rails of the bench belt conveyor 14. Alternatively, the hopper car can also run on its one running gear close to the face belt conveyor.

Figure 3:
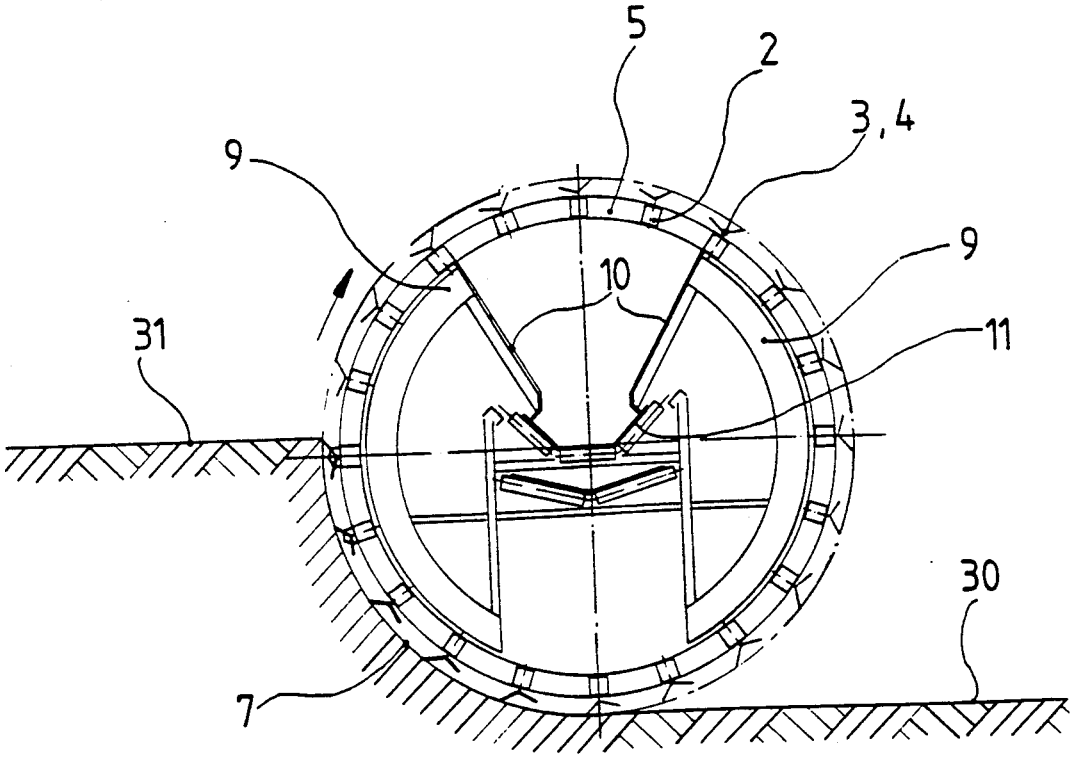
FIG. 3 is a cross sectional view through a cutting drum according to the invention.

FIG. 3 shows the construction of the cutting drum 1. The cutting drum is made up of cutter bars 2 on which are tiltably mounted the cutting teeth holders 3 with the cutting teeth 4. The drum rotates in the direction indicated by the arrow and moves past the two fixed curved liners 9. The material removed by the teeth 4 is directed into the interior of the cutting drum by means of cutter bars 2 and the flights 33 as they rotate over the fixed feed chute 10 and it is dumped onto the discharge belt 11.

Figure 2:
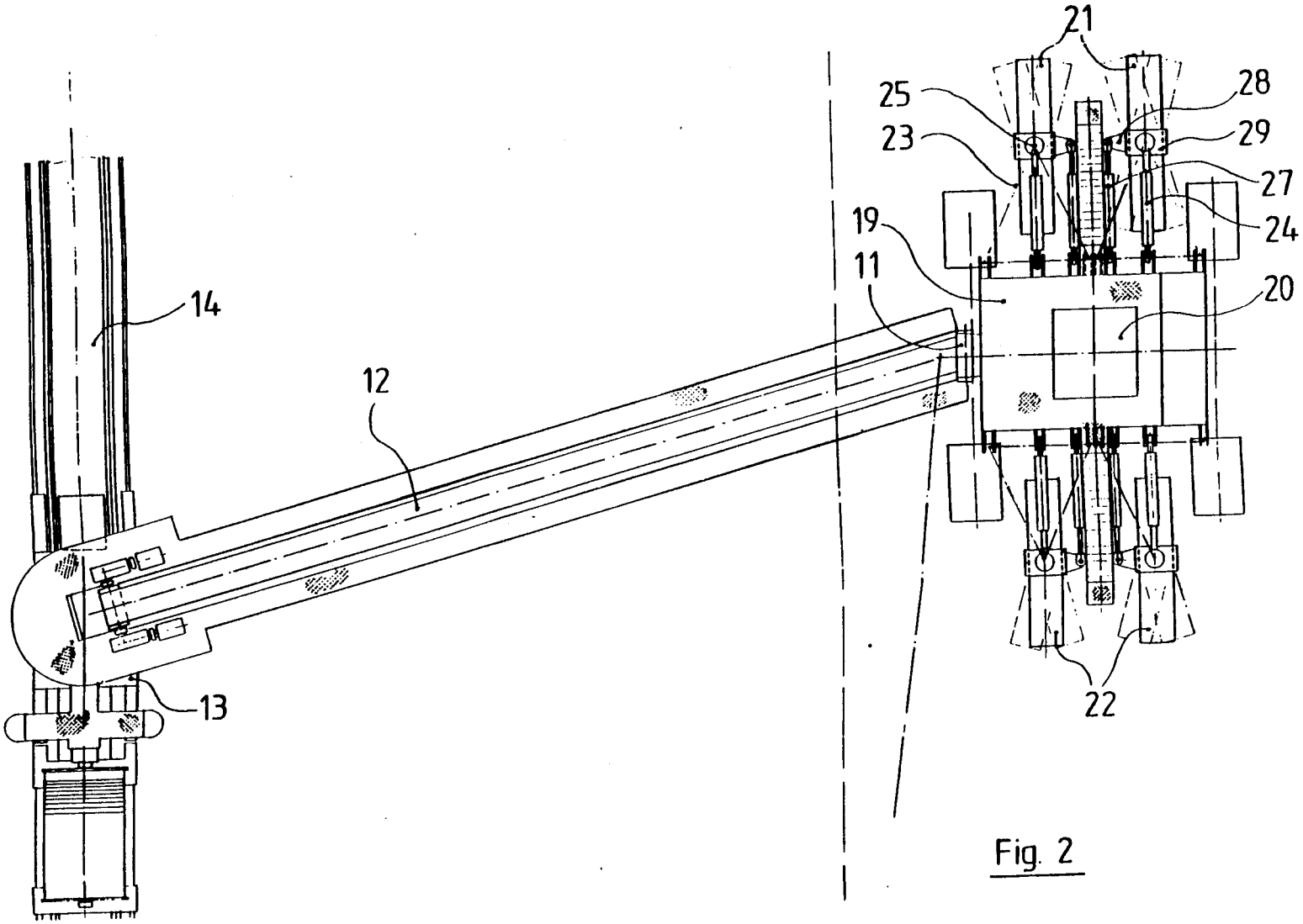
FIG. 2 is a top view of the mining machine shown in FIG. 1.

The flights 33 may either be attached to the teeth holders 3, as is the case in FIGS. 2 and 3, or they may also be attached to the cutter bars 2. In the radial direction they must end before they reach the zone of the clearance angle 6.

Figure 4:
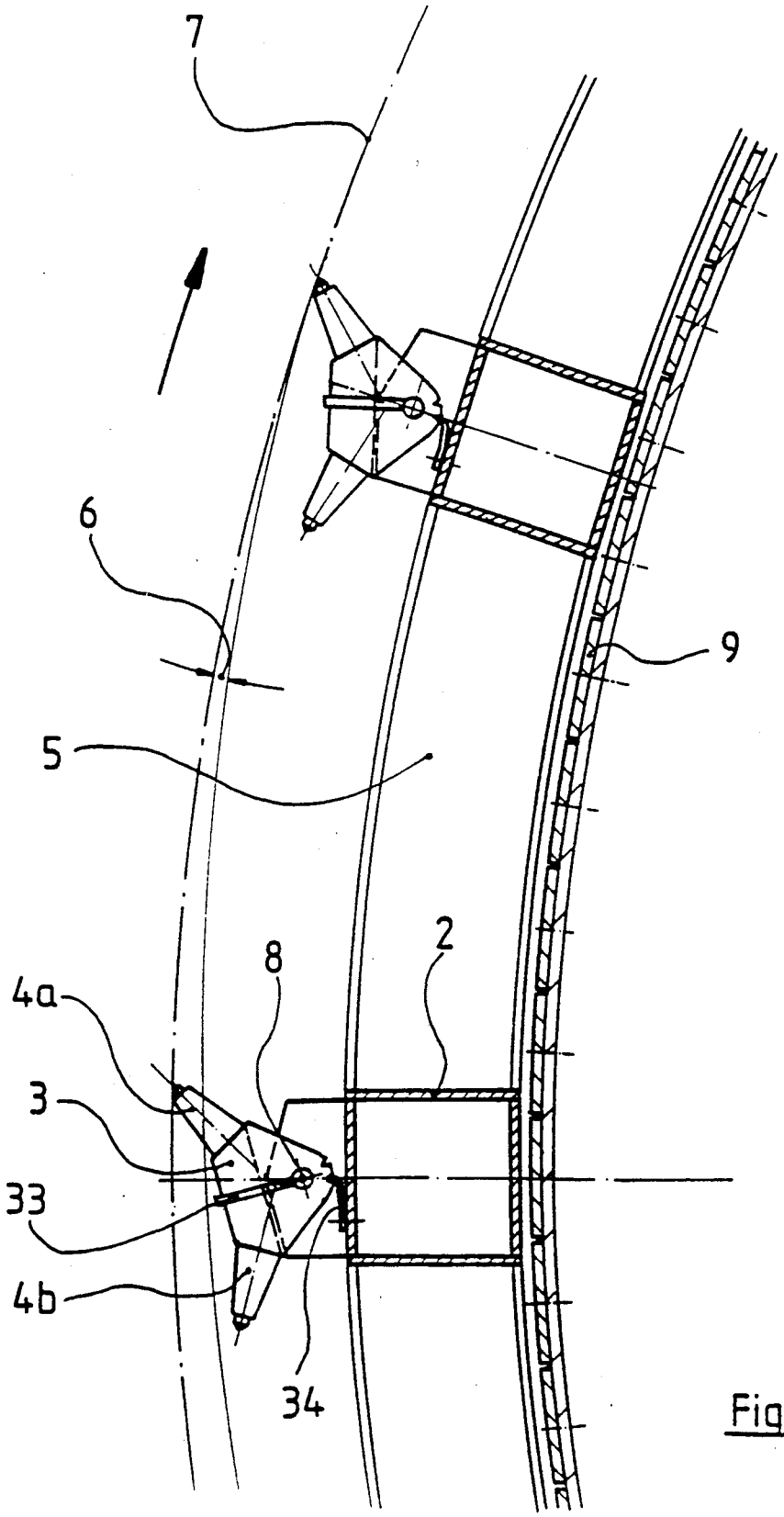
FIG. 4 are cutter bars with cutting teeth arranged in tilting holders according to the invention.

FIG. 4 in particular illustrates how the teeth 4 with teeth holders 3 tiltable about a geometrical axis of rotation 8 are arranged on the cutter bar 2. The tooth 4*a* is in engagement within the clearance angle 6 of the cutting circle 7. The tooth 4*b* is pivoted out of the zone of the clearance angle 6.

Because of the high degree of torsional and flexural loading the cutter bars 2 are joined together (in accordance with FIG. 4) by several rings 5 running circumferentially. In the embodiment illustrated, the cutter bars are designed as box sections. A spring loaded pawl 34 is provided between each cutting bar 2 and its associated holder 3.

Figure 5:
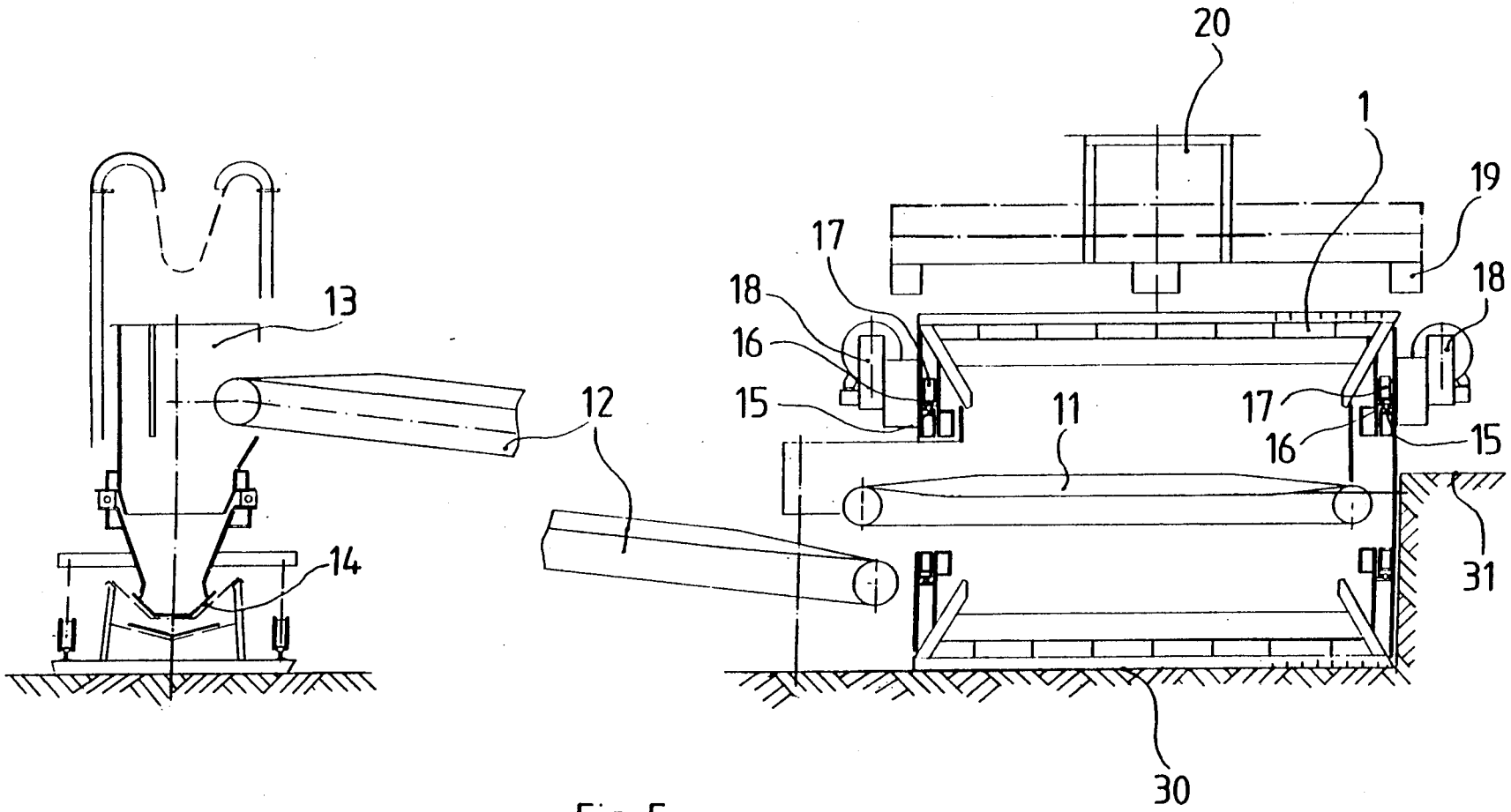
FIG. 5 is a sectional view of the mining machine according to the invention.

FIG. 5 shows a general view of the arrangement of the drives 16,17,18 for the cutting drum 1, the chassis 19 of the mining machine with the operator's cab 20, also the discharge conveyor belt 11, the bridge conveyor 12, (not shown as a continuous belt in the drawing), the hopper car 13 and the bench conveyor 14.

Cutting drum bearings 15 can be seen on both sides of the mining machine, and on each bearing is arranged a gear wheel 16 in which engages the pinion 17 of the drum drive 18.

In the embodiment illustrated in FIG. 5, the hopper car 13 runs on the rails of the bench conveyor 14.

Figure 9:
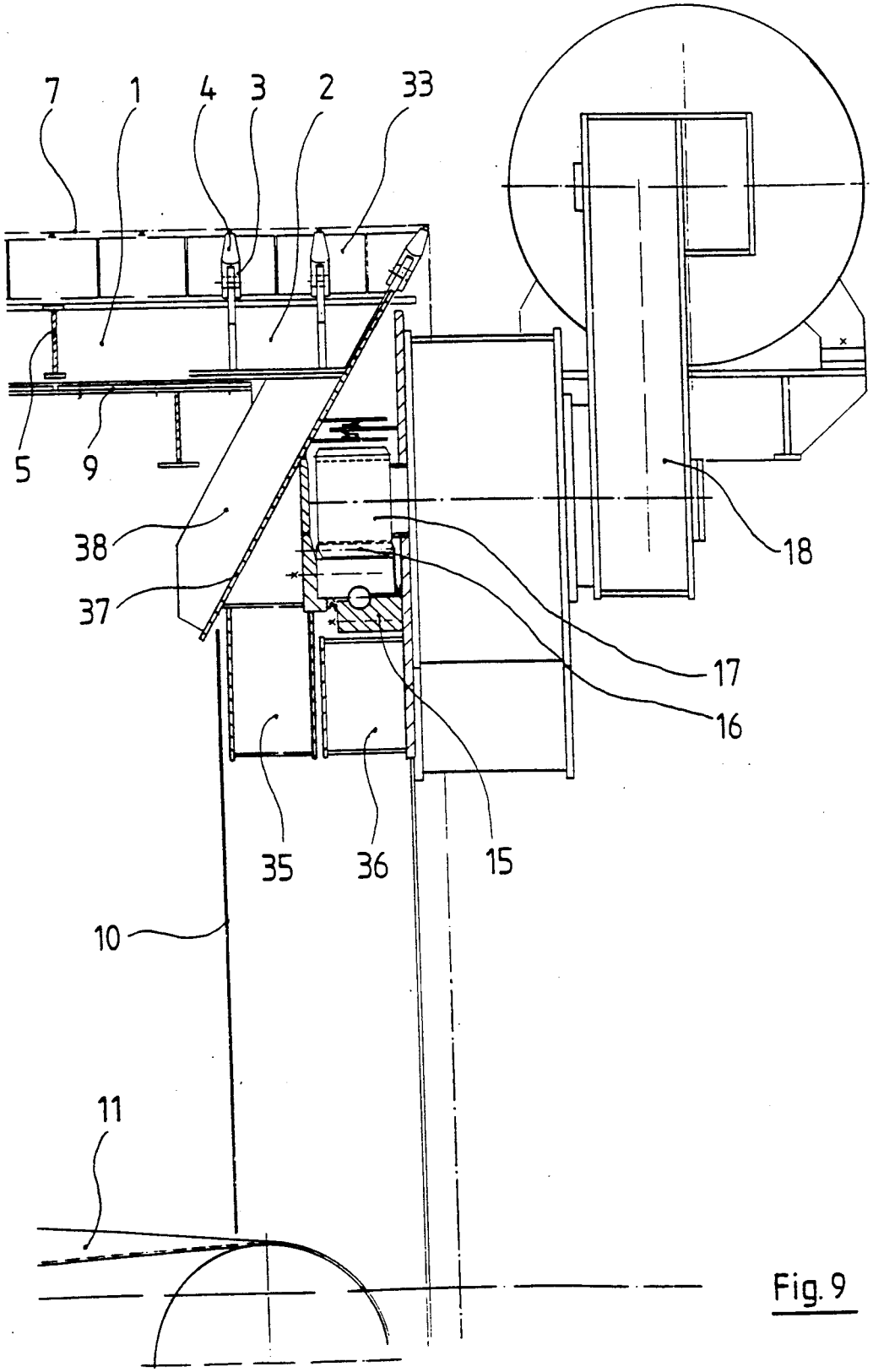
FIG. 9 is a sectional view of the cutting drum suspension system and the drum drive mechanism.

FIG. 9 is an enlarged detail view taken from FIG. 5 and shows a cutting drum bearing 15 with the gear wheel 16 which in this embodiment forms an integral component together with the bearing. A pinion 17 in the cutting drum drive engages in the gear wheel 16. The cutting drum bearing 15 is connected on the one side with the fixed ring member 36, which in turn is rigidly connected to the chassis 19 (not shown). To this fixed ring member 36 are also attached (again not numbered) the curved liner feed 9, the feed chute 10, and the discharge belt 11. At the opposite side, the drum 16 is connected to the rotating ring member 35, which forms part of the cutting drum.

The cutter bars 2 are joined via a conical ring 37 to the rotating ring member 35. The extracted material which is cut close to the ends of the cutting drum 1, flows over this conical ring 37 into the feed chute 10. (For design reasons, the curved liner 9 is shorter in the axial direction than the cutting drum 1). In order to ensure that this material is carried up to the necessary height as the cutting drum 1 rotates, radially arranged ribs 38 are attached to the conical ring 37, preferably one per cutter bar 2.

The arrangement illustrated in FIG. 9 is advantageously repeated, in symmetrically identical form, at the bend-side end of the cutting drum, with the exception that the inside of the fixed ring member 35 is left open, because it is at this point that the discharge conveyor belt 11 leads to the outside of the drum.

Figure 6:
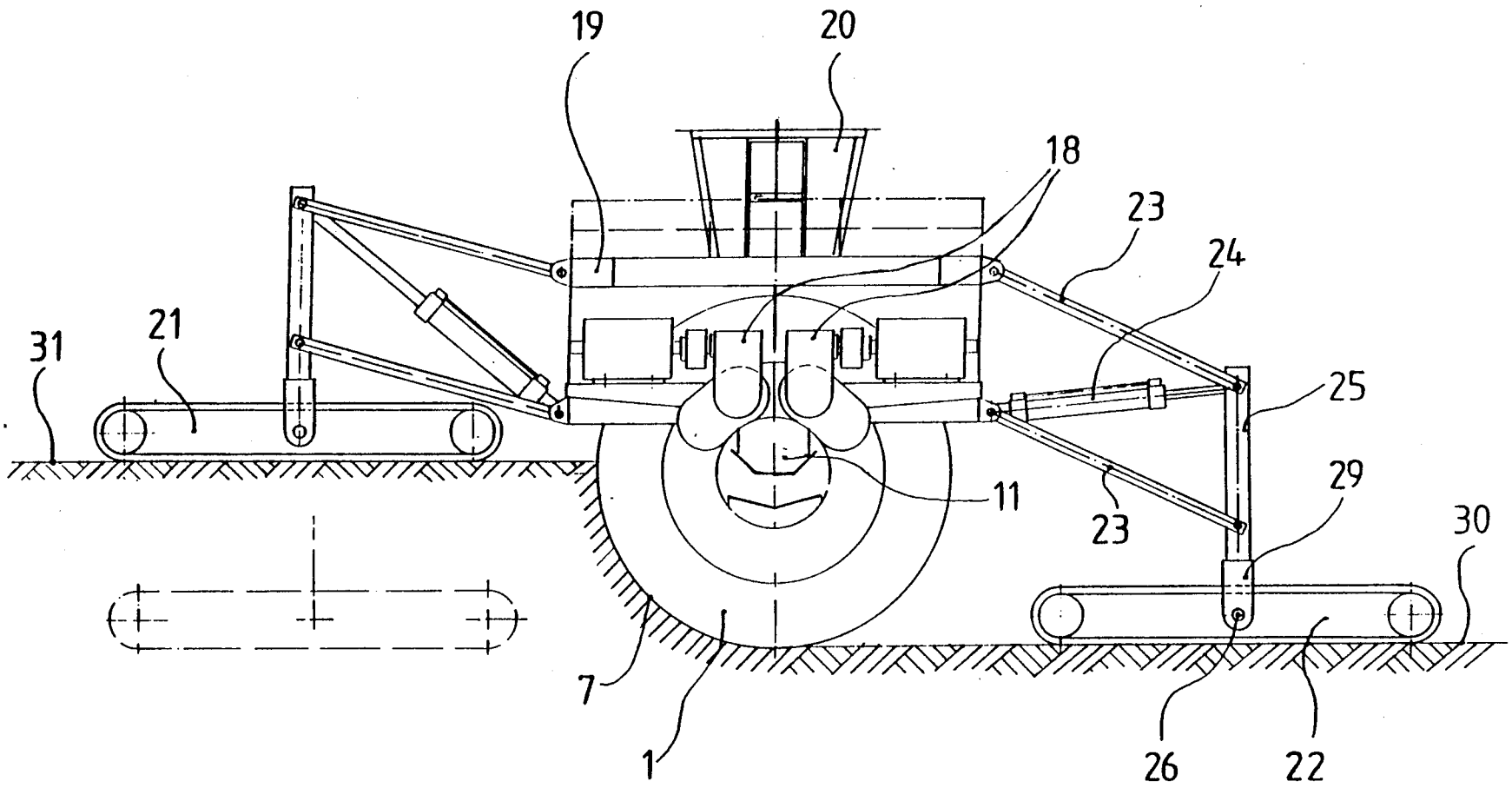
FIG. 6 is a side view of the mining machine, seen from the bench side.

FIG. 6 shows a side view of the mining machine similar to the perspective drawing at FIG. 1. The mining machine is shown here in an operating position.

Figure 7:
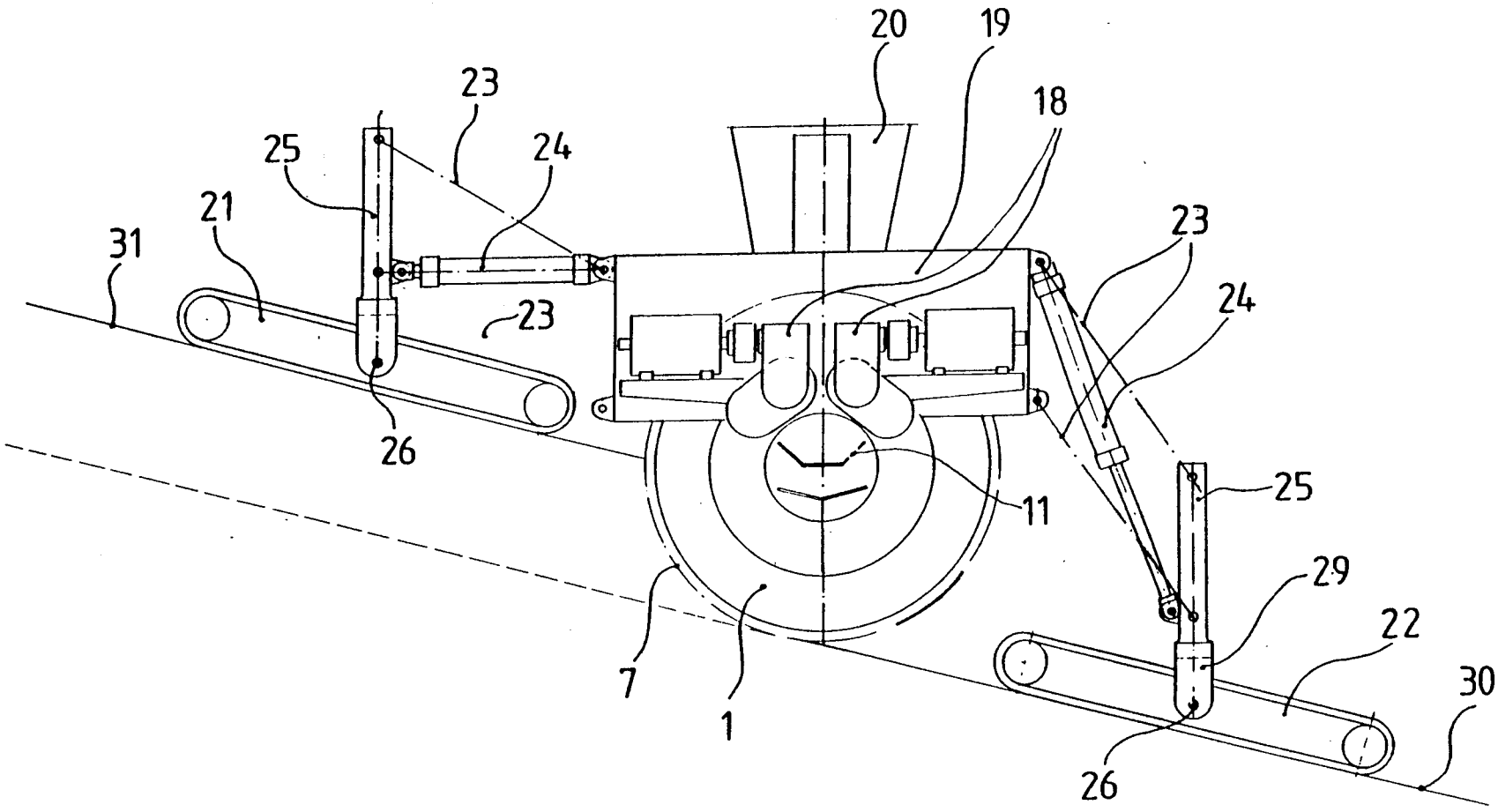
FIG. 7 is a view similar to that shown in FIG. 6, but with the machine operating on a steep incline.

As shown in FIG. 7, the mining machine can follow dipping seams much more easily than, for example, a bucket-wheel excavator.

By appropriately setting the front and rear lift cylinders 24 the machine can also operate and travel on extremely inclined surfaces. In this case, the discharge conveyor belt 11 and the cardanically attached bridge conveyor 12 are able to operate without tilting, i.e. without any risk of the belt running skew and allowing the mined material to slip off at the sides.

The center of gravity of the mining machine is located just above the support pattern formed by the joints 26 on the four continuous tracks 21, 22. Therefore, the machine is extremely stable even on very steep inclines.

The vertical component of the digging force is absorbed by the four continuous track units 21. 22. In so doing, the load exerted on the continuous track units is increased and thus the tractive effort is improved. With the aid of the continuous track drive units (not shown), the mining machine can therefore also negotiate steep inclines e.g. 1:6 to 1:4, instead of approximately 1:15 to 1:10 as is the case with the known types of bucket-wheel excavators.

Figure 8:
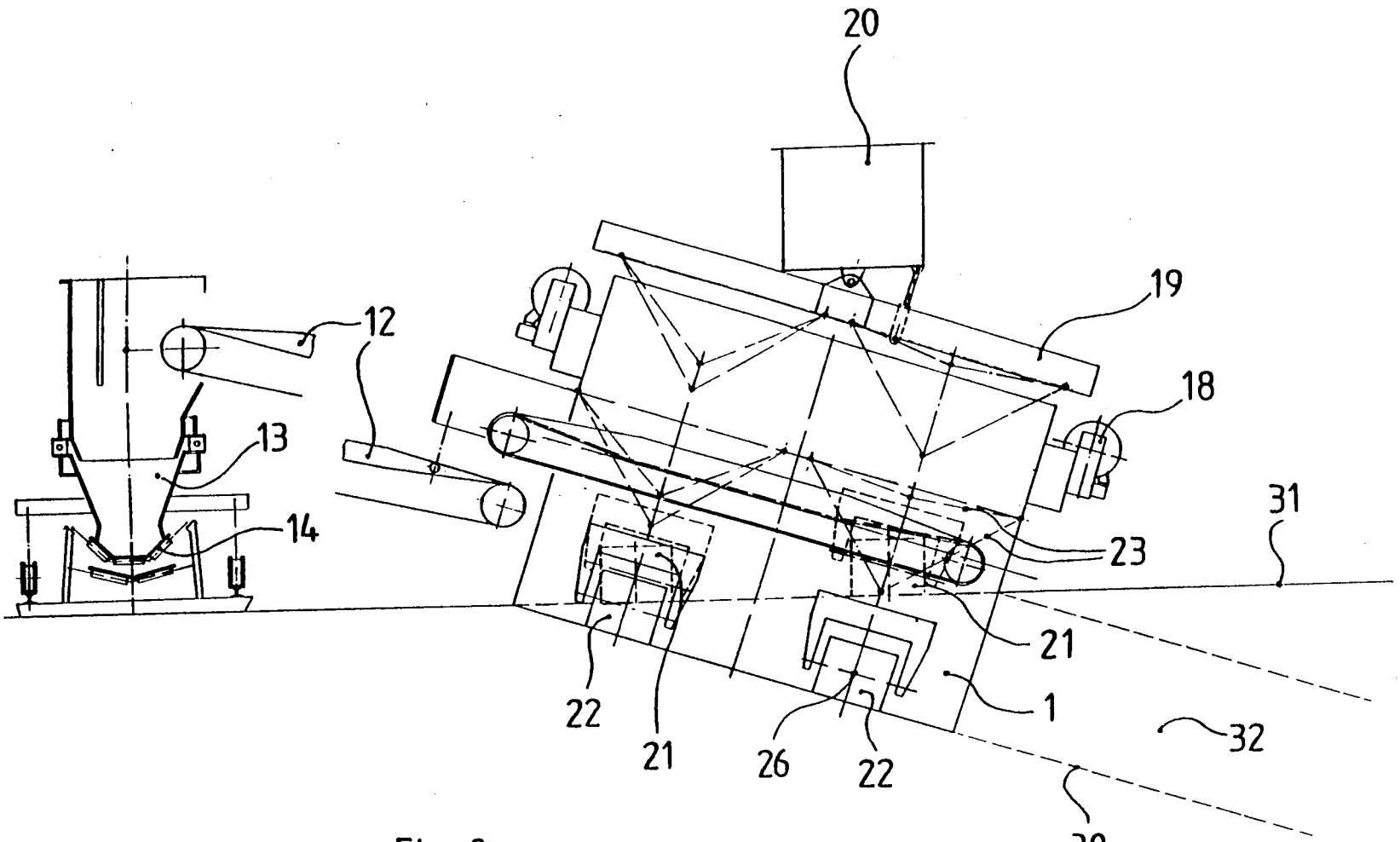
FIG. 8 is a view of the mining machine while cutting a development trench.

FIG. 8 illustrates how a development trench 32 is cut with the aid of the mining machine. The trench is as long as the open-cast mine and as deep as the layer to be extracted, e.g. 2 km long and 20 m deep.

Because the four continuous track units 21,22 on the mining machine can be independently adjusted for height by means of individual lift cylinders 24 the machine can also operate with an intentional lateral lilt. Use is made of this ability when preparing the development trench. The supporting bearings on the continuous tracks 21, 22 are formed in such a manner that the continuous track units can swivel freely to the desired extent (e.g. 15°) not only, as is usual, about an axis running transverse to the direction of travel but also about an axis in the direction of travel. For this purpose, the continuous track units are fitted with joints 26. In this connection, reference is also made to FIG. 7 in which the continuous track units 21, 22 with the parallelogram links 23, the lift cylinders 24, the support column 25, the continuous track unit joints 26 and the bottom brackets 29 of the support columns can be seen. The steering cylinders 27 and the lever arms 28 can be seen in FIG. 2.

The steering force must be exerted around the vertical central axis of the support column 25. For this purpose, the support column 25 may either be located in two rings which are held, in each case, by two upper and lower parallelogram links 23, and the steering cylinder 27 acts on lever arm 28 extending laterally from the support column 25; or the support column is not rotatable about its vertical axis. In this latter case, the continuous track unit is mounted by means of a joint 26 permitting rotation around all three axes, and the steering cylinder 27 acts on a lever arm 28 extending laterally from the continuous track chassis. In the first mentioned case the joints 26 must be prevented from rotating about the vertical axis, e.g. by using slide blocks on the continuous track chassis.

The amount of lateral inclination of the cutting drum 1 is limited by the angle of inclination of the axial discharge conveyor belt 11 and also by the contours of the chassis 19 of the mining machine and of the cutting drum drive 18, and it may be in the order of 15°.

By mining several strips with the machine tilted in the aforementioned manner, it is possible to cut a development trench of the desired depth.

It is advantageous if, as shown in FIG. 8, the operator's cab 20 on the mining machine can pivot laterally as the machine tilts, so that the operator is always seated in a horizontal plane.

Figure 10:
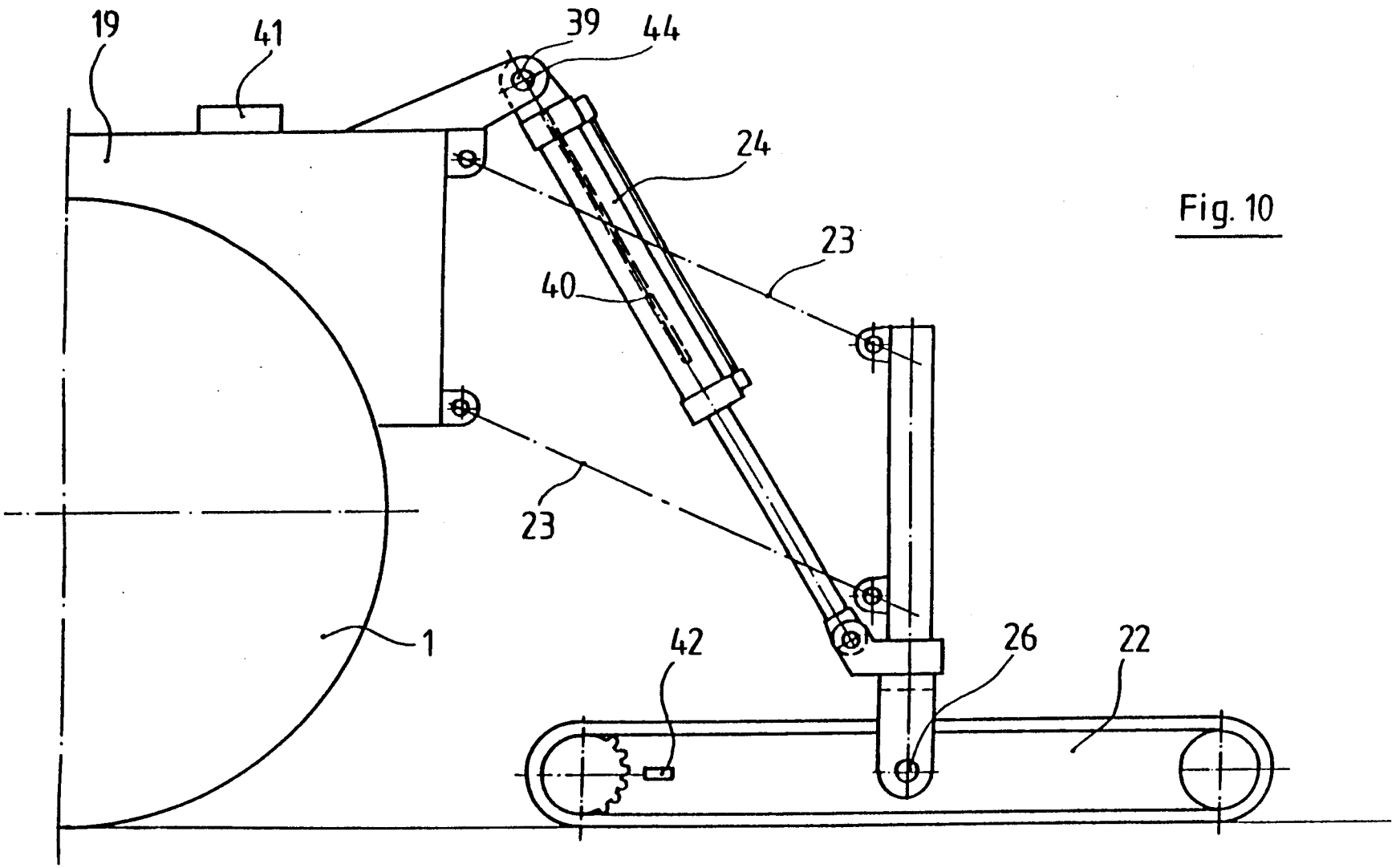
FIG. 10 is a detail view showing the arrangement of a force sensor on the lifting cylinder and showing a longitudinal travel sensor on a continuous track unit.

As can be seen from FIG. 10, each continuous track unit 22 in the continuous track system is equipped with a force sensor 39. The sensor, in the form of a force-measuring bolt, is advantageously located in the lift cylinder pivot joint 44 by means of which the lift cylinder 24 is attached to the machine chassis 19. The bolt must be mounted on the chassis in such a way that it cannot rotate. The vertical force component acting on the machine chassis is measured by suitably arranged strain gauges and is fed as a signal to the programmable controller 43 located in the operator's cab on the machine chassis 19. Depending on the measurements reported by the four force sensors 39, the torque force exerted by the drive motors of the continuous track units 22 are split up by the programmable controller 43.

Vertical travel sensors 40 may be installed, for example in the lift cylinders 24, as illustrated in FIG. 10. On the other hand, these sensors may also be arranged parallel alongside the lift cylinders.

The signals from the vertical travel sensors 40 are converted by the automation device 43 into the dimension "vertical travel of the respective continuous track relative to the machine chassis" taking account of the geometry of the continuous track suspension systems.

The longitudinal distance travelled by the continuous track units is scanned by the travel sensors 42 with which all four continuous track units 22 of the continuous track system are advantageously equipped. These travel sensors 42 are located for example in each case in the drive sprocket of a continuous track unit 22. With the data from these sensors a mean travel distance is calculated by the programmable controller 43. However, it is also possible to determine the smallest individual value if occasional slipping of a continuous track unit is feared, which would otherwise falsify the speed and distance measurements.

Finally, an attitude sensor 41 is fitted on the machine chassis 19 to measure the angular position of the machine chassis 19 relative to the geocenter, both in the direction of travel and transverse to the direction of travel of the mining machine.

The measurements from all the aforementioned sensors are transmitted to the programmable controller 43, which is a data evaluation and control unit of a known type.

The set values for the angular positions of the machine chassis, also the amount by which the front continuous track units of the continuous track system should be set higher than the rear continuous track units, i.e. the cut height h, are all fed into this programmable computer.

The programmable controller is also fed with the ratio by which the adjacent continuous track units should be loaded. While the mining machine is simply being transported, this ratio may be, for example 50% in each case. During normal mining operation, when the outer front continuous track unit 21 runs near the edge of the bank (upper level 31) it is advantageous to take most of the load off this unit, i.e. to divide up the total loading of the front continuous tracks in the ratio of, for example, 20% to 80%, and to divide the loading on the rear continuous tracks accordingly in the inverse ratio.

The risk of the bank edge (upper level 31) collapsing under the load of the continuous track unit running close to it could also, in principle, be prevented by pivoting both front continuous track units away from the bank edge, and at the same time pivoting the two rear continuous track units sideways in the opposite direction. To accomplish this, the parallelogram links could be variable in length (i.e. designed as hydraulic cylinders), or the parallelogram links on a continuous track unit could be attached to a frame pivotable about a vertical axis relative to the machine chassis.

The disadvantages of this solution (not shown here) of using laterally pivotable continuous track units is that it would be mechanically very much more complex. Also, the rear outer continuous track would limit the freedom of movement of the bridge conveyor linking the mining drum and bench conveyor.

Figure 11:
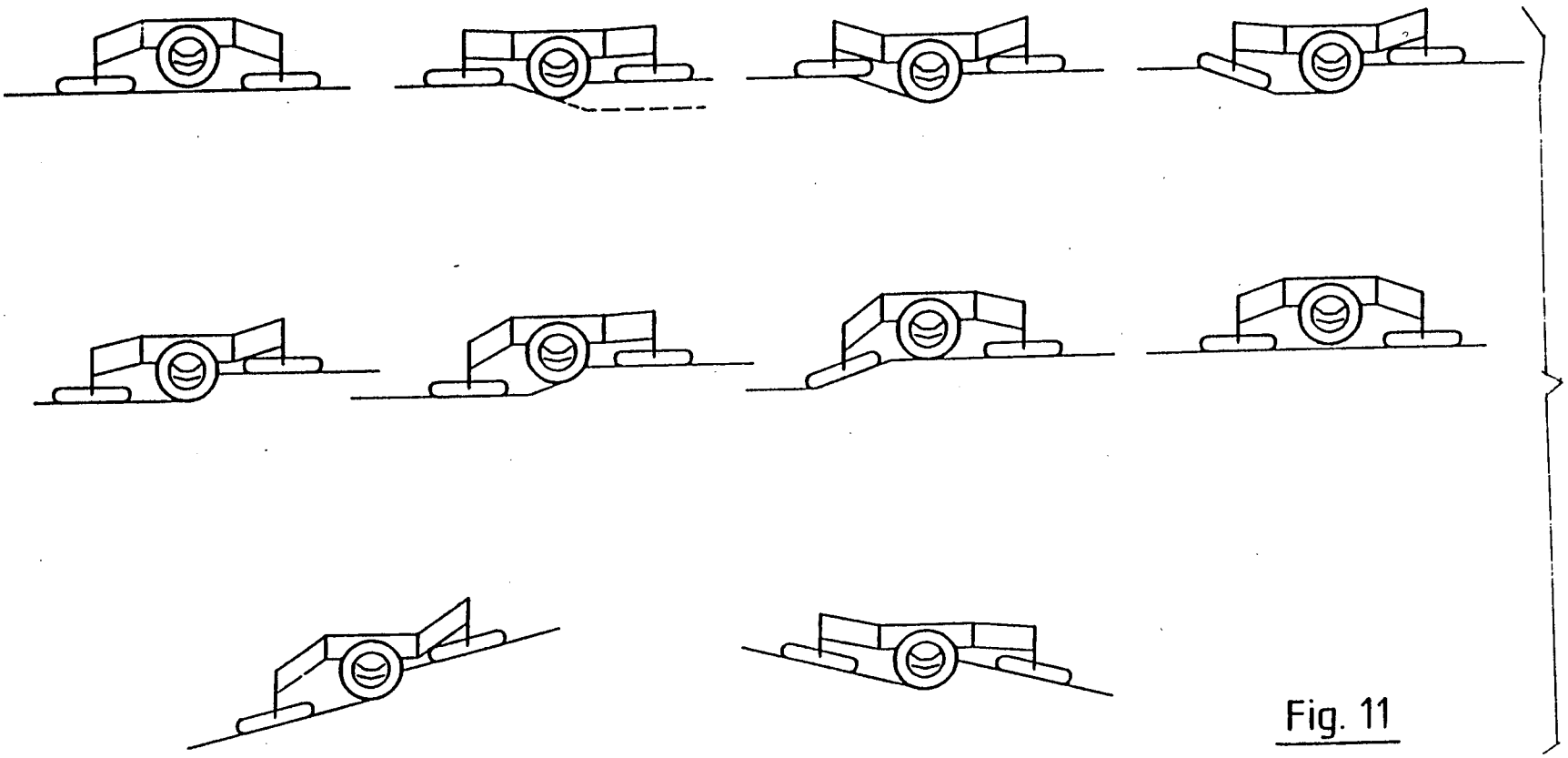
FIG. 11 is a schematic view showing the suspension system relative to the machine chassis, in various operating positions.

FIG. 11 depicts the sequence of movements of the continuous track suspension system relative to the machine chassis with the mining machine in a wide variety of operating positions, starting with transportation of the machine in a flat terrain, and ranging through normal mining operation to mining on rising or dipping upper and lower bench surfaces.

While a specific embodiment of the invention has been shown an described in detail to illustrate the application of the principles of the invention, it will be understood that the invention may be embodied otherwise without departing from such principles.

What is claimed is:

1. A continuous track mounted, self-propelled continuously operable open-case mining machine, comprising:

a drum-shaped mining element including a plurality of cutting bars joined with rotatable ring members by conical rings bearing radially arranged ribs, said cutting bars being arranged in a substantially axial pattern on the circumference of the drum, teeth holders arranged connected to said cutting bars, teeth supported by said teeth holders, each teeth older supporting teeth pointing in the direction of rotation of the drum and supporting teeth pointing in a direction opposite to the direction of rotation of the drum, said teeth pointing in the direction of rotation of the drum automatically pivoting into a cutting position as they engage the material to be extracted and said teeth pointing in the direction opposite to the direction of rotation of the drum automatically pivoting out of a clearance angel zone, said drum including flights connected to said cutter bars, a curved liner positioned within said cutting drum including a feed chute, said feed chute receiving mined material from said flights as said cutting drum is rotated, said feed chute being connected to a discharge belt arranged axially inside said cutting drum; and an additional conveyor belt connected to said discharge belt, said additional conveyor belt being positioned outside of said cutting drum.

2. A mining machine according to claim 1, wherein said cutting bars are joined together in the peripheral direction by means of one or more ring elements.

3. A mining machine according to claim 1, wherein said teeth holders are connected to a spring-loaded pawl element to prevent said teeth holders from tipping under their own weight.

4. A mining machine according to claim 1, wherein said cutting drum includes at least one end mounted gear wheel and at least one cutting drum drive.

5. A mining machine according to claim 4, wherein said cutting drum drive is arranged opposite a mine bench and a chassis of the mining machine and said cutting drum drive are positioned upon an upper level of the face to be mined.

6. A mining machine according to claim 1, wherein said cutting drum is mounted on both sides on large-diameter anti-friction bearings, said cutting drum including a gear wheel on at least one side, said gear wheel engaging pinions of the cutting drum drive, said anti-friction bearings and said gear wheels lying within the cutting drum on at least one side of the mining machine.

7. A mining machine according to claim 1, wherein said cutting drum is connected to a central chassis, chassis being connected to two sets of continuous track units including a front set of continuous track units and a back set of caterpillar units and, connection means connected to said front set of continuous track units and said back set of caterpillar units for independently raising and lowering each of said continuous track units.

8. A mining machine according to claim 7, wherein each of said front and back continuous track units are steerable.

9. A mining machine according to claim 8, wherein said caterpillar units are cardanically mounted at each joint.

10. A mining machine according to claim 7, wherein each of said continuous track units is equipped with a force sensor and a vertical travel sensor, said central chassis being equipped with an attitude sensor for measuring the longitudinal and transverse angle of the tile of said central chassis, programmable controller means being connected to each of said force sensor, vertical travel sensor and attitude sensor, said programmable controller means for adjusting the load on said individual continuous track units in a predetermined ratio, said controller unit controlling the spatial attitude of the central chassis so as to be maintained at a given angle of longitudinal and transverse tilt.

11. A mining machine according to claim 10, wherein said programmable control means includes means for inputting desired ramp geometry including length (l) of the ramp, cut height (h) and gradient tangle ($\alpha$), said programmable control mans controlling said positioning means based on signals from said vertical travel sensor and said attitude sensor for cutting a ramp according to data input into said programmable control means, said programmable controller maintaining said central chassis at pre-set transverse and longitudinal angle of tilt.

12. A mining machine according to claim 10, wherein said continuous track units include caterpillar drives, said programmable control unit splitting up torque forces exerted by said drives in a ratio of the vertical loadings on the continuous track units depending on signals from said individual force sensors.

13. A mining machine according to claim 7, wherein said front continuous track unit includes a caterpillar element which is set higher on a side opposite from a bench than its adjacent continuous track unit.

14. A mining machine according to claim 1, wherein said discharge conveyor belt is cardanically attached to said additional conveyor belt, said additional conveyor belt being cardanically connected to a hopper car on a discharge side of said bridge conveyor, said hopper car being arranged to travel above a bench conveyor.

15. A mining machine according to claim 14, wherein a two-point attachment of said bridge conveyor is provided between said bridge conveyor and said discharge conveyor and a single-point attachment is provided between said bridge conveyor and said hopper car.

16. A self-propelled, continuous track mounted, continuously operating mining device for strip mining, comprising:

a drum-shaped mining element having a circumferential surface; cutting tools pivotally connected to said circumferential surface; an opening formed in said circumferential surface defining a feed chute; a discharge conveyor, said discharge conveyor being arranged at least partially within said drum-shaped mining element positioned extended axially with respect to said drum-shaped mining element, said discharge conveyor having a discharge end connected with an additional conveyor;

flight means associated with each of said cutting tools for delivering mined material to said chute, each of said flight means and said cutting tools including a first operative side and a second operative side for mining during rotation of said drum-shaped mining element in either direction.

17. A mining device according to claim 16, wherein said drum-shaped mining element includes a plurality of cutting bars arranged on said circumferential surface, extending substantially parallel to a central axis of said drum-shaped mining element, said cutting tools being connected to said cutting bars and including tooth holders carrying teeth, each of said tooth holders being mounted tiltably around an axis of rotation such that said tooth holder pivots into a cutting position in which teeth pointing in a direction of rotation engage a material to be mined under an effect of a digging resistance and teeth pointing in an opposite direction swing out of an area of a free cutting angle of said teeth performing the digging operation.

18. A device according to claim 16 wherein:

said drum-shaped mining element includes a plurality of cutting bars arranged substantially parallel to a central axis of said drum-shaped mining element, said cutting tools include tooth holders carrying sets of teeth, said tooth holders being pivotably mounted to said cutting bars such that teeth pointing in a direction of rotation will automatically pivot into a cutting position during engagement with material to be mined under the effect of a digging resistance and teeth pointing in an opposite direction are swung out of an area of pre-cutting angle of said teeth pointing in the direction of rotation, said flight means including tearing plates, said tearing plate being connected to each of said tooth holders, and positioned locking means for maintaining said tooth holders and associated tearing plates in a position to avoid tilting during delivery of mined material to said chute.

19. A continuous track mounted, self-propelled continuously operable open-cast mining machine, comprising:

a drum-shaped mining element including a plurality of cutting bars joined with rotatable ring members by conical rings bearing radially arranged ribs, said cutting bars being arranged in a substantially axial pattern on the circumference of the drum, teeth holders arranged connected to said cutting bars, teeth supported by said teeth holders, each teeth holder supporting teeth pointing in the direction of rotation of the drum and supporting teeth pointing in a direction opposite to the direction of rotation of the drum, said teeth pointing in the direction of rotation of the drum automatically pivoting into a cutting position as they engage the material to be extracted and said teeth pointing in the direction opposite to the direction of rotation of the drum automatically pivoting out of a clearance angle zone, said drum including flights connected to said cutter bars, a curved liner positioned within said cutting drum including a feed chute, said feed chute receiving mined material from said flights as said cutting drum is rotated, said feed chute being connected to a discharge belt arranged axially inside said cutting drum; and an additional conveyor belt connected to said discharge belt, said additional conveyor belt being positioned outside of said cutting drum, wherein said cutting drum is mounted on both sides on large-diameter anti-friction bearings, said cutting drum including a gear wheel on at least one side, said gear wheel engaging pinions of the cutting drum drive, said anti-friction bearings and said gear wheels lying within the cutting drum on at least one side of the mining machine.

* * * * *